US009086640B2

(12) United States Patent
Nishida et al.

(10) Patent No.: US 9,086,640 B2
(45) Date of Patent: Jul. 21, 2015

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Tsutomu Nishida, Mishima (JP); Junpei Kuno, Mishima (JP); Kaname Watariguchi, Mishima (JP); Masataka Kawahara, Mishima (JP); Masato Tanaka, Tagata-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/013,951

(22) Filed: Aug. 29, 2013

(65) Prior Publication Data

US 2014/0065530 A1 Mar. 6, 2014

(30) Foreign Application Priority Data

Aug. 31, 2012 (JP) ..... 2012-191431
Jan. 22, 2013 (JP) ..... 2013-009495

(51) Int. Cl.

| | |
|---|---|
| ***G03G 5/00*** | (2006.01) |
| ***G03G 5/05*** | (2006.01) |
| ***G03G 5/06*** | (2006.01) |
| ***G03G 5/09*** | (2006.01) |
| ***G03G 5/14*** | (2006.01) |

(52) U.S. Cl.

CPC ..... *G03G 5/0517* (2013.01); *G03G 5/0514* (2013.01); *G03G 5/0521* (2013.01); *G03G 5/067* (2013.01); *G03G 5/0612* (2013.01); *G03G 5/0614* (2013.01); *G03G 5/0637* (2013.01); *G03G 5/0696* (2013.01); *G03G 5/09* (2013.01); *G03G 5/142* (2013.01)

(58) Field of Classification Search

CPC ..... G03G 5/0696
USPC ..... 430/59.4, 78, 56; 399/159
See application file for complete search history.

(56) References Cited

U.S. PATENT DOCUMENTS

2014/0065531 A1 3/2014 Nishida et al.

FOREIGN PATENT DOCUMENTS

| | | | |
|---|---|---|---|
| JP | 10-301307 | A | 11/1998 |
| JP | 2006-072304 | A | 3/2006 |
| JP | 2008-015532 | A | 1/2008 |
| WO | 9324861 | A | 12/1993 |

OTHER PUBLICATIONS

European Search Report dated Nov. 13, 2013, Reference EP70061, Application No. 13180345.4.
European search report, dated Nov. 4, 2013, Reference EP70059, Application No. 13180344.7-1303.

*Primary Examiner* — Mark A Chapman
(74) *Attorney, Agent, or Firm* — Canon U.S.A. Inc., IP Division

(57) ABSTRACT

A photosensitive layer of an electrophotographic photosensitive member includes a phthalocyanine pigment and a specific dicyanoethylene compound. Alternatively, the photosensitive layer and/or an undercoat layer of the electrophotographic photosensitive member include a specific dicyanoethylene compound, and the photosensitive layer includes the phthalocyanine pigment.

17 Claims, 1 Drawing Sheet

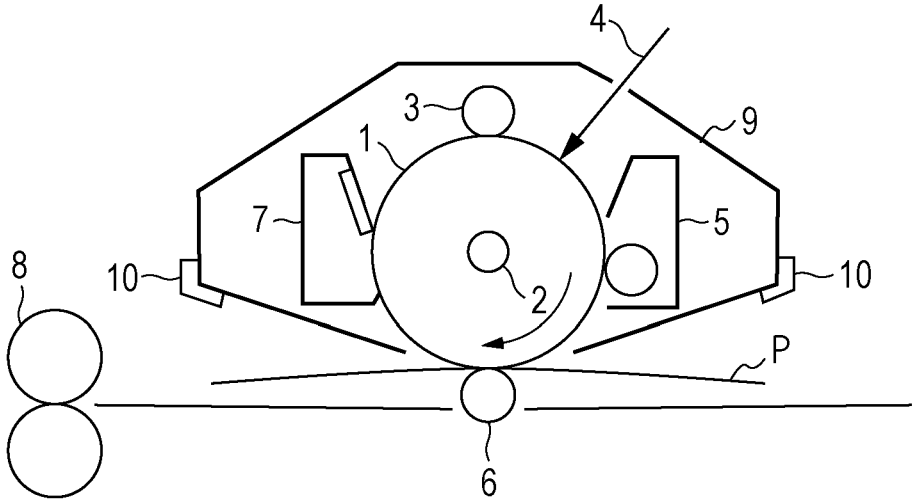
4
3
9
1
7
5
8
10
2
10
P
6

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member and to a process cartridge and an electrophotographic apparatus each including the electrophotographic photosensitive member.

2. Description of the Related Art

Various charge-generating substances used for electrophotographic photosensitive members have been developed. Among these substances, phthalocyanine pigments, which have high sensitivity, are often used.

However, higher sensitivity of an electrophotographic photosensitive member is liable to cause photomemory in the electrophotographic photosensitive member by light penetrated from the outside of a process cartridge or an electrophotographic apparatus. Recently, this has been required to be improved. The term "photomemory" indicates a phenomenon in which carriers are accumulated in a portion irradiated with light (irradiated portion) to cause a potential difference between the irradiated portion and a portion that is not irradiated with light (non-irradiated portion), which can cause a reduction in image quality (image reproducibility).

Japanese Patent Laid-Open Nos. 2006-72304 and 2008-15532 disclose a technique in which a phthalocyanine pigment and an organic electron acceptor compound are used in combination, and a technique in which a charge-generating layer includes a pigment sensitizing dopant having an electron acceptor molecule.

However, the use of the techniques disclosed in Japanese Patent Laid-Open Nos. 2006-72304 and 2008-15532 does not result in sufficient improvement in photomemory.

SUMMARY OF THE INVENTION

Aspects of the present invention provide an electrophotographic photosensitive member that inhibits the occurrence of photomemory, and a process cartridge and an electrophotographic apparatus each including the electrophotographic photosensitive member.

One disclosed aspect of the present invention provides an electrophotographic photosensitive member having a support, and a photosensitive layer formed on the support, in which the photosensitive layer has a phthalocyanine pigment, and a dicyanoethylene compound represented by the formula (1) described below.

Another aspect of the present invention provides an electrophotographic photosensitive member having a support, an undercoat layer formed on the support, and a photosensitive layer formed on the undercoat layer, in which the undercoat layer has a dicyanoethylene compound represented by the formula (1) described below, and the photosensitive layer has a phthalocyanine pigment.

(1)

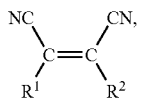

wherein, in the formula (1), $R^1$ and $R^2$ each independently represent an unsubstituted or substituted alkyl group, an unsubstituted or substituted aryl group, an unsubstituted or substituted pyridyl group, an unsubstituted or substituted thienyl group, an unsubstituted or substituted piperidyl group, or a substituted amino group.

Another aspect of the present invention provides a process cartridge detachably attachable to a main body of an electrophotographic apparatus, in which the process cartridge integrally supports the electrophotographic photosensitive member described above and at least one device selected from the group consisting of a charging device, a developing device, and a cleaning device.

Another aspect of the present invention provides an electrophotographic apparatus having the electrophotographic photosensitive member described above, a charging device, an exposure device, a developing device, and a transferring device.

Further features of the present invention will become apparent from the following description of exemplary embodiments with reference to the attached drawing.

BRIEF DESCRIPTION OF THE DRAWINGS

FIGURE illustrates a schematic structure of an electrophotographic apparatus including a process cartridge with an electrophotographic photosensitive member according to an embodiment of the present invention.

DESCRIPTION OF THE EMBODIMENTS

An electrophotographic photosensitive member according to an embodiment of the present invention contains a dicyanoethylene compound represented by the following formula (1):

(1)

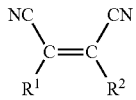

wherein, in the formula (1), $R^1$ and $R^2$ each independently represent an unsubstituted or substituted alkyl group, an unsubstituted or substituted aryl group, an unsubstituted or substituted pyridyl group, an unsubstituted or substituted thienyl group, an unsubstituted or substituted piperidyl group, or a substituted amino group.

Examples of the alkyl group include a methyl group, an ethyl group, a propyl group, and a butyl group. Examples of the aryl group include a phenyl group and a naphthyl group.

Examples of a substituent that may be attached to the groups include alkyl groups, such as a methyl group, an ethyl group, a propyl group, and a butyl group; aryl groups, such as a phenyl group, a naphthyl group, and a phenalenyl group; halogen atoms, such as a fluorine atom, a chlorine atom, and a bromine atom; alkyl group-substituted amino groups, such as a dimethylamino group and a diethylamino group; hydroxyalkyl group-substituted amino groups, such as a di(hydroxymethyl)amino group and a di(hydroxyethyl) amino group; hydroxy group-substituted amino groups, such as a dihydroxyamino group; aryl group-substituted amino groups, such as a diphenylamino group, a ditolylamino group, and a dixylylamino group; an amino group (an unsubstituted amino group); and a hydroxy group.

In the case where the electrophotographic photosensitive member includes a support and a photosensitive layer arranged on the support and where the photosensitive layer contains a phthalocyanine pigment, the photosensitive layer may further contain a dicyanoethylene compound represented by the foregoing formula (1). In the case where the photosensitive layer includes a charge-generating layer and a charge-transporting layer arranged on the charge-generating layer, the phthalocyanine pigment and the dicyanoethylene compound represented by the formula (1) may be contained in the charge-generating layer.

In the case where the electrophotographic photosensitive member includes the support, an undercoat layer arranged on the support, and the photosensitive layer arranged on the undercoat layer and where the photosensitive layer contains the phthalocyanine pigment, the undercoat layer may contain the dicyanoethylene compound represented by the formula (1). In the case where the photosensitive layer includes the charge-generating layer and the charge-transporting layer arranged on the charge-generating layer, the phthalocyanine pigment may be contained in the charge-generating layer. The dicyanoethylene compound represented by the formula (1) may also be contained in the photosensitive layer (charge-generating layer) in addition to the undercoat layer.

In the formula (1), $R^1$ and $R^2$ may each represent an amino group substituted with a pyridyl group, a piperidyl group, an alkyl group, or an aryl group, or an aryl group substituted with a secondary amine or a tertiary amine.

While specific examples (exemplary compounds) of the dicyanoethylene compound represented by the formula (1) will be illustrated below, the present invention is not limited thereto. Among the following exemplary compounds, a dicyanoethylene compound represented by any one of the formulae (1-1) to (1-3) may be used.

(1-1)

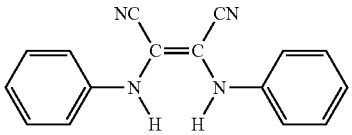

(1-2)

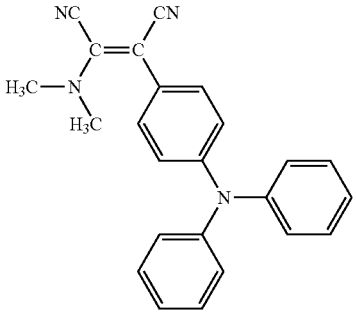

(1-3)

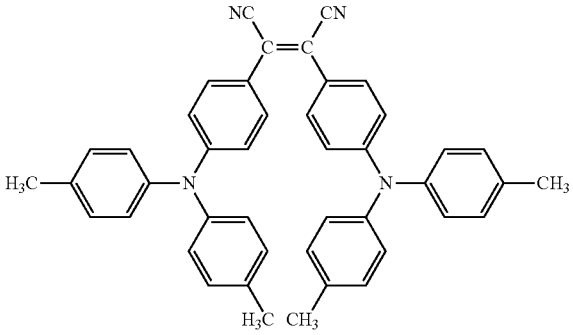

-continued (1-4)

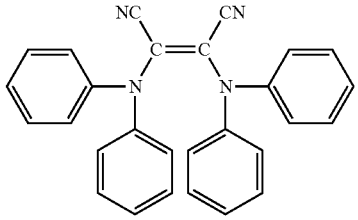

(1-5)

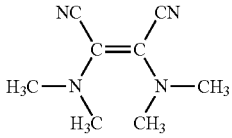

(1-6)

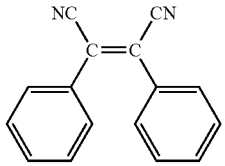

(1-7)

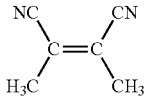

(1-8)

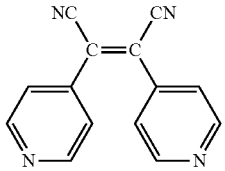

(1-9)

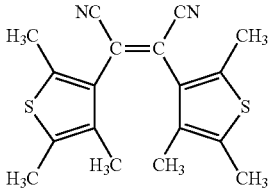

(1-10)

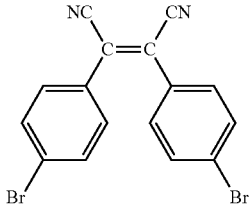

(1-11)

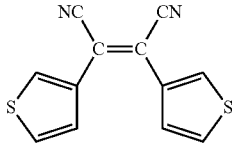

(1-12)

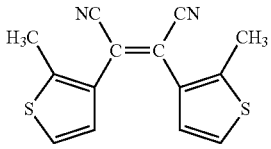

-continued (1-13)

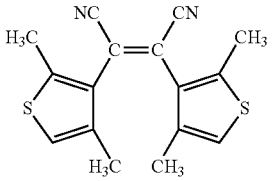

(1-14)

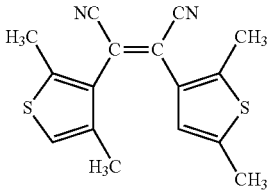

(1-15)

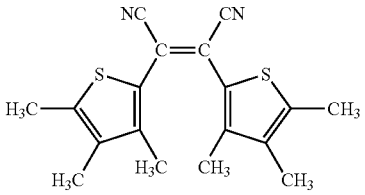

(1-16)

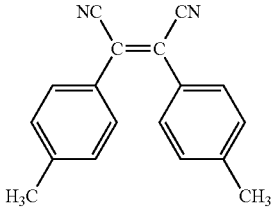

(1-17)

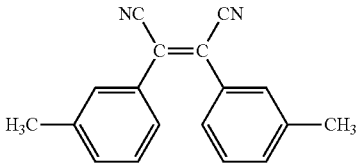

(1-18)

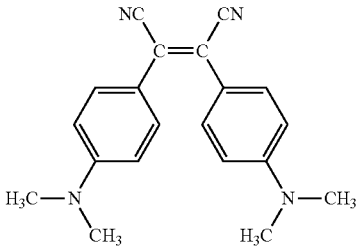

(1-19)

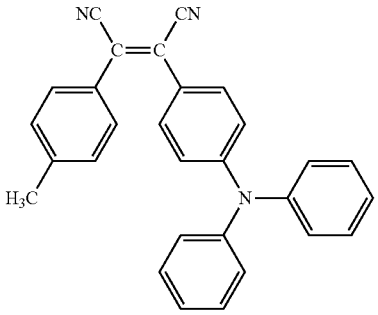

-continued (1-20)

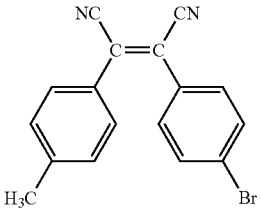

(1-21)

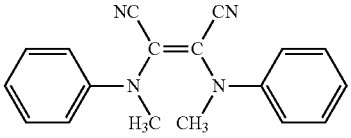

(1-22)

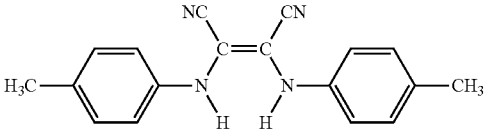

(1-23)

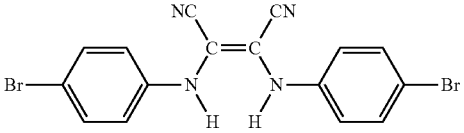

(1-24)

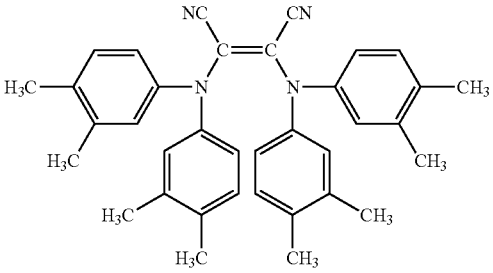

Hereinafter, the foregoing compounds are also referred to as "exemplary compounds (1-1) to (1-24)".

The inventors believe that among a variety of dicyanoethylene compounds, the dicyanoethylene compound represented by the formula (1) is combined with the phthalocyanine skeleton of the phthalocyanine pigment in a well-matched fashion. Furthermore, the inventors believe that the cyano groups, which serve as electron-withdrawing groups, of the dicyanoethylene compound represented by the formula distort the spatial extent of an electron orbit in a molecule of the phthalocyanine pigment and withdraw residual carriers in the phthalocyanine pigment to improve photomemory.

The lowest unoccupied molecular orbital (LUMO) of the dicyanoethylene compound represented by the formula (1), the LUMO being obtained from the results of molecular orbital calculation by density functional calculation at the B3LYP/6-31G level, may be in the range of −2.4 eV to −2.0 eV from the viewpoint of achieving more efficient withdrawal of the residual carriers in the phthalocyanine pigment.

The dipole moment of the dicyanoethylene compound represented by the formula (1), the dipole moment being obtained from the results of molecular orbital calculation by density functional calculation at the B3LYP/6-31G level, may be 6.5 debye or more from the viewpoint of sufficiently distorting the spatial extent of the electron orbital in a molecule of the phthalocyanine pigment.

The inventors believe that in the case where the dicyanoethylene compound represented by the formula (1) is contained in the photosensitive layer (charge-generating layer) or in the undercoat layer, the photomemory is improved by the foregoing effect.

The molecular orbital calculation was performed by density functional theory (DFT) using a Gaussian basis set. Time-dependent density-functional theory (TDDFT) was used for the calculation of the transition dipole moment and the LUMO. In DFT, the exchange-correlation interaction is approximated by a functional (defined as a function of a function) of a one-electron potential expressed in electron density, thus achieving fast calculation. In embodiments of the present invention, the weights of parameters relating to the exchange-correlation energy were defined by the B3LYP hybrid functional. Furthermore, 6-31G serving as a basis function was applied to all atoms. Examples of the phthalocyanine pigment include metal-free phthalocyanine and metal phthalocyanines. These compounds may have axial ligands and/or substituents.

Among such phthalocyanine pigments, oxytitanium phthalocyanines and gallium phthalocyanines have particularly high sensitivity and are liable to cause photomemory. Thus, the present invention may be useful therefor.

Among gallium phthalocyanines, hydroxygallium phthalocyanine and chlorogallium phthalocyanine may be used. Among these compounds, a hydroxygallium phthalocyanine crystal of a crystal form that exhibits strong peaks at 7.4°±0.3° and 28.2°±0.3° of Bragg angles (2θ) in X-ray diffraction with CuKα characteristic radiation and a chlorogallium phthalocyanine crystal of a crystal form that exhibits strong peaks at 7.4°, 16.6°, 25.5°, and 28.0° of Bragg angles (2θ±0.2°) in X-ray diffraction with CuKα characteristic radiation may be used.

Among oxytitanium phthalocyanines, an oxytitanium phthalocyanine crystal of a crystal form that exhibits strong peaks at 27.2°±0.2° of a Bragg angle (2θ) in X-ray diffraction with CuKα characteristic radiation may be used.

Among these compounds, a hydroxygallium phthalocyanine crystal of a crystal form in which strong peaks are observed at 7.3°, 24.9°, and 28.1° of Bragg angles (2θ±0.2°) in X-ray diffraction with CuKα characteristic radiation and in which the peak at 28.1° is the strongest peak, and a hydroxygallium phthalocyanine crystal of a crystal form that exhibits strong peaks at 7.5°, 9.9°, 16.3°, 18.6°, 25.1°, and 28.0° of Bragg angles (2θ±0.2°) in X-ray diffraction with CuKα characteristic radiation may be used.

The electrophotographic photosensitive member according to an embodiment of the present invention includes the support and the photosensitive layer.

The photosensitive layer may be a photosensitive layer having a single-layer structure in which a charge-transporting substance and a charge-generating substance are contained in one layer. Alternatively, the photosensitive layer may be a photosensitive layer having a laminated structure (functionally separated structure) including a charge-generating layer that contains a charge-generating substance and a hole-transporting layer that contains a hole-transporting substance. From the viewpoint of achieving good electrophotographic properties, the photosensitive layer having a laminated structure may be used. The photosensitive layer having a laminated structure may include the charge-generating layer and the charge-transporting layer arranged on the charge-generating layer from the viewpoint of achieving good electrophotographic properties.

The support may be a support having electrical conductivity (conductive support). Examples of the support that may be used include supports composed of metals (alloys), such as aluminum and stainless steel; and supports composed of metals, plastics, and paper, each of the supports having a conductive coating film on a surface thereof.

Examples of the shape of the support include cylindrical shapes and film-like shapes.

The undercoat layer (also referred to as an "intermediate layer") having barrier and adhesive functions may be provided between the support and the photosensitive layer.

The undercoat layer may be formed by applying an undercoat layer coating liquid, which is prepared by dissolving a resin (and the dicyanoethylene compound represented by the formula (1)) in a solvent, on the support or a conductive layer described below and then drying the resulting coating film.

Examples of the resin used for the undercoat layer include polyvinyl alcohol, polyethylene oxide, ethyl cellulose, methyl cellulose, casein, polyamide, glue, and gelatine.

As described above, the undercoat layer may contain the dicyanoethylene compound represented by the formula (1).

The undercoat layer may have a thickness of 0.3 to 5.0 μm.

A conductive layer may be provided between the support and the undercoat layer or between the support and the photosensitive layer in order to cover up the unevenness and defects of the surface of the support and suppress interference fringes.

The conductive layer may be formed by applying a conductive layer coating liquid, which is prepared by dispersing conductive particles, e.g., carbon black particles, metal particles, or metal oxide particles, in a solvent together with a binder resin, on the support and drying or curing the resulting coating film.

The conductive layer preferably has a thickness of 5 to 40 μm and more preferably 10 to 30 μm.

In the case where the photosensitive layer is a photosensitive layer having a laminated structure, the charge-generating layer may be formed by applying a charge-generating layer coating liquid, which is prepared by dispersing the phthalocyanine pigment serving as a charge-generating substance and a binder resin (and the dicyanoethylene compound represented by the formula (1)) in a solvent, and drying the resulting coating film. The dicyanoethylene compound represented by the formula (1) may be added to a dispersion, which is prepared by dispersing the phthalocyanine pigment serving as a charge-generating substance and the binder resin in the solvent, to prepare a charge-generating layer coating liquid.

The charge-generating layer preferably has a thickness of 0.05 to 1 μm and more preferably 0.1 to 0.3 μm.

As described above, the photosensitive layer (charge-generating layer) may contain the dicyanoethylene compound represented by the formula (1).

In the case where the charge-generating layer contains the dicyanoethylene compound represented by the formula (1), the content of the dicyanoethylene compound represented by the formula (1) in the charge-generating layer is preferably in the range of 0.05% to 15% by mass and more preferably 0.1% to 10% by mass with respect to the total mass of the charge-generating layer. Furthermore, the content of the dicyanoethylene compound represented by the formula (1) in the charge-generating layer is preferably in the range of 0.1% to 20% by mass and more preferably 0.3% to 10% by mass with respect to the phthalocyanine pigment serving as a charge-generating substance.

The content of the charge-generating substance in the charge-generating layer is preferably in the range of 30% to 90% by mass and more preferably 50% to 80% by mass with respect to the total mass of the charge-generating layer.

The phthalocyanine pigment and a substance (for example, an azo pigment) other than the phthalocyanine pigment may be used in combination as the charge-generating substances used for the charge-generating layer. In this case, the content of the phthalocyanine pigment may be 50% by mass or more with respect to the total mass of the charge-generating substances.

The dicyanoethylene compound represented by the formula (1) and contained in the photosensitive layer (charge-generating layer) and/or the undercoat layer may be amorphous or crystalline.

Furthermore, two types of dicyanoethylene compounds represented by the formula (1) may be used in combination.

Examples of the binder resin that may be used for the charge-generating layer include resins, such as polyester, acrylic resins, phenoxy resins, polycarbonate, polyvinyl butyral, polystyrene, polyvinyl acetate, polysulfone, polyarylate, vinylidene chloride, acrylonitrile copolymers, and polyvinyl benzal. Among these resins, polyvinyl butyral and polyvinyl benzal may be used.

In the case where the photosensitive layer is a photosensitive layer having a laminated structure, the charge-transporting layer may be formed by applying a charge-transporting layer coating liquid, which is prepared by dissolving the charge-transporting substance and a binder resin in a solvent, and drying the resulting coating film.

The charge-transporting layer preferably has a thickness of 5 to 40 μm and more preferably 10 to 25 μm.

The content of the charge-transporting substance in the charge-transporting layer is preferably in the range of 20% to 80% by mass and more preferably 30% to 60% by mass with respect to the total mass of the charge-transporting layer.

Examples of the charge-transporting substance include triarylamine compounds, hydrazone compounds, stilbene compounds, pyrazoline compounds, oxazole compounds, thiazole compounds, and triallylmethane compounds. Among these compounds, triarylamine compounds may be used.

Examples of the binder resin used for the charge-transporting layer include resins, such as polyester, acrylic resins, phenoxy resins, polycarbonate, polystyrene, polyvinyl acetate, polysulfone, polyarylate, vinylidene chloride, and acrylonitrile copolymers. Among these resins, polycarbonate and polyarylate may be used.

In the case where the photosensitive layer is a photosensitive layer having a single-layer structure, the photosensitive layer having a single-layer structure may be formed by applying a coating liquid for the photosensitive layer having a single-layer structure, the coating liquid being prepared by dispersing the phthalocyanine pigment serving as a charge-generating substance, the charge-transporting substance, and the binder resin (and the dicyanoethylene compound represented by the formula (1)) in a solvent, and drying the resulting coating film.

A protective layer may be provided on the photosensitive layer in order to protect the photosensitive layer.

The protective layer may be formed by applying a protective layer coating liquid, which is prepared by dissolving a resin in a solvent, on the photosensitive layer and drying or curing the resulting coating film. In the case where the coating film is cured, curing may be performed by, for example, heat, an electron beam, or ultraviolet radiation. Examples of the resin that may be dissolved include polyvinyl butyral, polyester, polycarbonate, nylon, polyimide, polyarylate, polyurethane, styrene-butadiene copolymers, styrene-acrylic acid copolymers, and styrene-acrylonitrile copolymers.

The protective layer may have a thickness of 0.05 to 20 μm.

Examples of a method for applying the coating liquid for each layer include an immersion coating method (a dipping method), a spray coating method, a spin coating method, a bead coating method, a blade coating method, and a beam coating method.

A layer serving as a surface layer of the electrophotographic photosensitive member may contain conductive particles, an ultraviolet absorber, and lubricant particles, such as fluorine atom-containing resin particles. Examples of the conductive particles include metal oxide particles, such as tin oxide particles.

FIGURE illustrates a schematic structure of an electrophotographic apparatus including a process cartridge with an electrophotographic photosensitive member according to an embodiment of the present invention.

Reference numeral 1 denotes a cylindrical (drum-shaped) electrophotographic photosensitive member, which is rotationally driven around a shaft 2 at a predetermined peripheral speed (process speed) in the direction indicated by an arrow.

A surface (peripheral surface) of the electrophotographic photosensitive member 1 is uniformly charged to a predetermined positive or negative potential with a charging device (primary charging device) 3 during rotation. Then, the surface of the electrophotographic photosensitive member 1 is irradiated with exposure light (image exposure light) 4 emitted from an exposure device (image exposure device) (not illustrated) to form an electrostatic latent image corresponding to a target image on the surface of the electrophotographic photosensitive member 1. The exposure light 4 is light which is emitted from the exposure device employing, for example, slit exposure or laser beam scanning exposure and which is intensity-modulated in response to a time-series electrical digital image signal of target image information.

The electrostatic latent image formed on the surface of the electrophotographic photosensitive member 1 is developed with a toner contained in a developing device 5 (by a normal or reversal developing method) to form a toner image on the surface of the electrophotographic photosensitive member 1. The toner image formed on the surface of the electrophotographic photosensitive member 1 is transferred onto a transfer medium P with a transferring device 6. At this time, a voltage having a reverse polarity to the charge polarity of the toner is applied to the transferring device 6 from a power source (not illustrated). In the case where the transfer medium P is paper, the transfer medium P is taken out from a paper feeding unit (not illustrated) and fed to a portion between the electrophotographic photosensitive member 1 and the transferring device 6 in synchronization with the rotation of the electrophotographic photosensitive member 1.

The transfer medium P to which the toner image has been transferred from the electrophotographic photosensitive member 1 is separated from the surface of the electrophotographic photosensitive member 1, conveyed to a fixing device 8, and subjected to fixation of the toner image. The transfer medium P is then conveyed as an image formed product (print or copy) to the outside of the electrophotographic apparatus.

The surface of the electrophotographic photosensitive member 1 after the transfer of the toner image to the transfer medium P, is cleaned by removing adherents, such as the toner (residual toner after transfer), with a cleaning device 7. In recent years, a cleaner-less system has been developed. In such a case, the residual toner after transfer can be removed by a developing device or the like. The surface of the electrophotographic photosensitive member 1 is subjected to charge elimination by pre-exposure light (not illustrated) emitted from a pre-exposure device (not illustrated) and then is repeatedly used for image formation. In the case where the charging device 3 is a contact charging device using, for example, a charging roller, the pre-exposure device is not always required.

In an embodiment of the present invention, a plurality of components selected from the components, such as the electrophotographic photosensitive member 1, the charging device 3, the developing device 5, and the cleaning device 7 may be arranged in a housing and integrally supported to form a process cartridge. The process cartridge may be detachably attached to the main body of an electrophotographic apparatus. For example, at least one device selected from the charging device 3, the developing device 5, and the cleaning device 7 is supported together with the electrophotographic photosensitive member 1 into a process cartridge 9 detachably attached to the main body of the electrophotographic apparatus using a guiding device 10, such as a rail of the main body of the electrophotographic apparatus.

In the case where the electrophotographic apparatus is a copier, the exposure light 4 may be light reflected from a document or light passing through a document. Alternatively, the exposure light 4 may be light emitted by, for example, scanning of a laser beam or driving of a light-emitting diode (LED) array or a liquid crystal shutter array, in which the scanning and driving are controlled in response to signals into which information of a document read by a sensor is converted.

The electrophotographic photosensitive member 1 according to an embodiment of the present invention is widely applicable to, for example, copiers, laser beam printers, CRT printers, LED printers, FAX machines, liquid-crystal printers, liquid crystal shutter printers, and laser plate making.

EXAMPLES

While the present invention will be described in more detail below by specific examples, the present invention is not limited thereto. Film thicknesses in examples and comparative examples were determined with an eddy-current coating thickness gauge (FISCHERSCOPE, manufactured by Fischer Instruments K.K.) or by converting mass per unit area using specific gravity.

Example 1

An aluminum cylinder (JIS-A3003, aluminum alloy) having a diameter of 24 mm and a length of 257.5 mm was used as a support (cylindrical support).

Into a ball mill, 60 parts of barium sulfate particles covered with tin oxide (trade name: Pastran PC1, manufactured by Mitsui Mining and Smelting Co., Ltd.), 15 parts of titanium oxide particles (trade name: TITANIX JR, manufactured by Tayca Corporation), 43 parts of a resol-type phenolic resin (trade name: Phenolite J-325, manufactured by Dainippon Ink and Chemicals, Inc., solid content: 70% by mass), 0.015 parts of silicone oil (trade name: SH28PA, manufactured by Toray Silicone Co., Ltd.), 3.6 parts of silicone resin particles (trade name: Tospearl 120, manufactured by Toshiba Silicone Co., Ltd.), 50 parts of 2-methoxy-1-propanol, and 50 parts of methanol were charged. The mixture was subjected to dispersion treatment for 20 hours to prepare a conductive layer coating liquid. The conductive layer coating liquid was applied to the support by dipping. The resulting coating film is cured by heating for 1 hour at 140° C. to form a conductive layer having a thickness of 15 μm.

Next, 10 parts of a nylon copolymer (trade name: Amilan CM8000, manufactured by Toray Industries, Inc.) and 30 parts of a methoxymethylated nylon 6 (trade name: Toresin EF-30T, manufactured by Teikoku Chemical Industries, Inc.) were dissolved in a solvent mixture of 400 parts of methanol and 200 parts of n-butanol to prepare an undercoat layer coating liquid. The undercoat layer coating liquid was applied onto the conductive layer by dipping. The resulting coating film was dried for 6 minutes at 80° C. to form an undercoat layer having a thickness of 0.45 μm.

Into a sand mill using glass beads of 1 mm in diameter, 10 parts of a hydroxygallium phthalocyanine crystal (charge-generating substance) of a crystal form that exhibits strong peaks at 7.5°, 9.9°, 16.3°, 18.6°, 25.1°, and 28.0° of Bragg angles (2θ±0.2°) in X-ray diffraction with CuKα characteristic radiation, 0.1 parts of exemplary compound (1-1), 5 parts of polyvinyl butyral (trade name: S-LEC BX-1, manufactured by Sekisui Chemical Co., Ltd.), and 250 parts of cyclohexanone were charged. The mixture was subjected to dispersion treatment for 4 hours. Then 250 parts of ethyl acetate was added thereto to prepare a charge-generating layer coating liquid. The charge-generating layer coating liquid was applied onto the undercoat layer. The resulting coating film was dried for 10 minutes at 100° C. to form a charge-generating layer having a thickness of 0.17 μm.

Next, 40 parts of a compound (charge-transporting substance (hole-transporting compound)) represented by the formula (C-1):

(C-1)

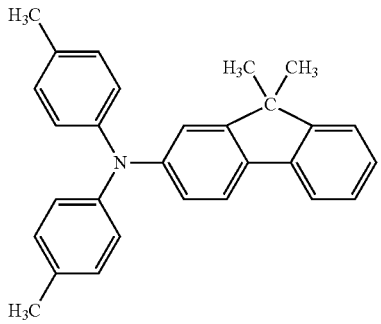

40 parts of a compound (charge-transporting substance (hole-transporting compound)) represented by the formula (C-2):

(C-2)

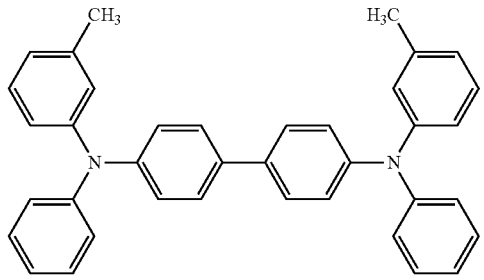

and 100 parts of polycarbonate (trade name: Iupilon 2200, manufactured by Mitsubishi Engineering-Plastics Corporation) were dissolved in a solvent mixture of 600 parts of monochlorobenzene and 200 parts of dimethoxymethane to prepare a charge-transporting layer coating liquid. The charge-transporting layer coating liquid was applied onto the charge-generating layer by dipping. The resulting coating film was allowed to stand for 10 minutes and then dried for 30 minutes at 120° C. to form a charge-transporting layer having a thickness of 13 μm.

Thereby, the cylindrical (drum-shaped) electrophotographic photosensitive member was produced.

Examples 2 to 8, 14, and 15

Electrophotographic photosensitive members according to Examples 2 to 8 were produced as in Example 1, except that exemplary compounds (1-2) to (1-10) were used in place of exemplary compound (1-1) to prepare charge-generating layer coating liquids.

Example 9

An electrophotographic photosensitive member according to Example 9 was produced as in Example 1, except that exemplary compound (1-1) was not used to prepare the charge-generating layer coating liquid and that 0.3 parts of exemplary compound (1-1), the nylon copolymer, and the methoxymethylated nylon 6 were dissolved in the solvent mixture of 400 parts of methanol and 200 parts of n-butanol to prepare an undercoat layer coating liquid.

Examples 10 and 11

Electrophotographic photosensitive members according to Examples 10 and 11 were produced as in Example 9, except that exemplary compounds (1-2) and (1-3) were used in place of exemplary compound (1-1) to prepare undercoat layer coating liquids.

Example 12

An electrophotographic photosensitive member according to Example 12 was produced as in Example 1, except that 0.1 parts of exemplary compound (1-1) was used to prepare the charge-generating layer coating liquid and that 0.3 parts of exemplary compound (1-1), the nylon copolymer and the methoxymethylated nylon 6 were dissolved in the solvent mixture of 400 parts of methanol and 200 parts of n-butanol to prepare an undercoat layer coating liquid.

Comparative Example 1

An electrophotographic photosensitive member according to Comparative Example 1 was produced as in Example 1, except that exemplary compound (1-1) was not used to prepare the charge-generating layer coating liquid.

Comparative Examples 2 to 5

Electrophotographic photosensitive members according to Comparative Examples 2 to 5 were produced as in Example 1, except that comparative compounds (2-1) to (2-4) described below were used in place of exemplary compound (1-1) to prepare charge-generating layer coating liquids.

(2-1)

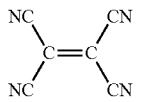

-continued (2-2)

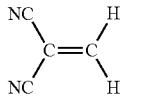

(2-3)

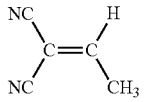

(2-4)

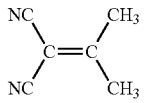

Comparative Example 6

An electrophotographic photosensitive member according to Comparative Example 6 was produced as in Example 9, except that comparative compound (2-1) was used in place of exemplary compound (1-1) to prepare an undercoat layer coating liquid.

Comparative Example 7

An electrophotographic photosensitive member according to Comparative Example 7 was produced as in Example 12, except that comparative compound (2-1) was used in place of exemplary compound (1-1) to prepare a charge-generating layer coating liquid and that comparative compound (2-1) was used in place of exemplary compound (1-1) to prepare an undercoat layer coating liquid.

Example 13

An electrophotographic photosensitive member according to Example 13 was produced as in Example 1, except that an oxytitanium phthalocyanine crystal of a crystal form that exhibits strong peaks at 9.0°, 14.2°, 23.9°, and 27.1° of Bragg angles (2θ±0.2°) in X-ray diffraction with CuKα characteristic radiation was used as the charge-generating substance.

Comparative Example 8

An electrophotographic photosensitive member according to Comparative Example 8 was produced as in Example 13, except that comparative compound (2-1) was used in place of exemplary compound (1-1) to prepare a charge-generating layer coating liquid.

Evaluation of Examples 1 to 15 and Comparative Examples 1 to 8

Evaluations of photomemory were performed with a modified device of a laser beam printer (trade name: Laser Jet Pro 400 Color M451dn) manufactured by Hewlett-Packard Company. With respect to the point of modification, the laser power was changed to 0.40 μJ/cm$^2$.

A method for evaluating photomemory is as follows: A surface (peripheral surface) of each of the electrophotographic photosensitive members was partially shielded from light. An unshielded portion (portion to be irradiated) was irradiated with 1500 lux of light from a fluorescent lamp for 5 minutes. The light potential of the surface of the electrophotographic photosensitive member was measured with the modified device of the laser beam printer. A difference (potential difference) in light potential V1 between the irradiated portion and the non-irradiated portion, i.e., ΔVl [V], was evaluated as photomemory.

$$\Delta Vl = Vl \text{ at irradiated portion} - Vl \text{ at non-irradiated portion}$$

A lower value of ΔVl indicates that photomemory is more inhibited.

Table 1 describes the results.

TABLE 1

| | Dicyanoethylene compound represented by formula (1) and other things | | | | | |
|---|---|---|---|---|---|---|
| | Exemplary compound/comparative compound | Dipole moment [debye] | LUMO [V] | Layer used | Charge-generating substance | Photomemory ΔVI [V] |
| Example 1 | (1-1) | 7.1 | −2.2 | charge-generating layer | hydroxygallium phthalocyanine | 4 |
| Example 2 | (1-2) | 8.8 | −2.0 | | | 3 |
| Example 3 | (1-3) | 11.5 | −2.4 | | | 2 |
| Example 4 | (1-4) | 7.9 | −2.3 | | | 5 |
| Example 5 | (1-5) | 7.6 | −1.8 | | | 6 |
| Example 6 | (1-6) | 7.7 | −2.8 | | | 6 |
| Example 7 | (1-7) | 6.5 | −2.4 | | | 7 |
| Example 8 | (1-8) | 3.1 | −3.5 | | | 10 |
| Example 9 | (1-1) | 7.1 | −2.2 | undercoat layer | | 9 |
| Example 10 | (1-2) | 8.8 | −2.0 | | | 8 |
| Example 11 | (1-3) | 11.5 | −2.4 | | | 8 |
| Example 12 | (1-1) | 7.1 | −2.2 | undercoat layer and charge-generating layer | | 4 |
| Example 13 | (1-1) | 7.1 | −2.2 | charge-generating layer | oxytitanium phthalocyanine | 12 |
| Example 14 | (1-9) | 6.4 | −2.6 | | hydroxygallium phthalocyanine | 8 |
| Example 15 | (1-10) | 2.6 | −2.1 | | | 10 |
| Comparative Example 1 | not used | | | charge-generating layer | hydroxygallium phthalocyanine | 13 |
| Comparative Example 2 | (2-1) | 0.0 | −5.0 | | | 13 |
| Comparative Example 3 | (2-2) | 4.3 | −2.9 | | | 16 |
| Comparative Example 4 | (2-3) | 5.2 | −2.5 | | | 15 |
| Comparative Example 5 | (2-4) | 5.9 | −2.2 | | | 14 |
| Comparative Example 6 | (2-1) | 0.0 | −5.0 | undercoat layer | | 13 |
| Comparative Example 7 | (2-1) | 0.0 | −5.0 | undercoat layer and charge-generating layer | | 13 |
| Comparative Example 8 | (2-1) | 0.0 | −5.0 | undercoat layer and charge-generating layer | oxytitanium phthalocyanine | 9 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-191431 filed Aug. 31, 2012 and No. 2013-009495 filed Jan. 22, 2013, which are hereby incorporated by reference herein in their entirety.

What is claimed is:

1. An electrophotographic photosensitive member comprising:

a support; and a photosensitive layer formed on the support, wherein the photosensitive layer comprises:

a phthalocyanine pigment; and a dicyanoethylene compound represented by the following formula (1):

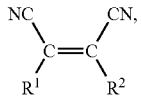

(1)

wherein, in the formula (1), $R^1$ and $R^2$ each independently represent an unsubstituted or substituted alkyl group, an unsubstituted or substituted aryl group, an unsubstituted or substituted pyridyl group, an unsubstituted or substituted thienyl group, an unsubstituted or substituted piperidyl group, or a substituted amino group.

2. The electrophotographic photosensitive member according to claim 1, wherein the photosensitive layer comprises:

a charge-generating layer; and a charge-transporting layer formed on the charge-generating layer, wherein the charge-generating layer comprises:

the phthalocyanine pigment; and the dicyanoethylene compound represented by the formula (1).

3. The electrophotographic photosensitive member according to claim 2, wherein the content of the dicyanoethylene compound represented by the formula (1) in the charge-generating layer is in the range of 0.1% to 20% by mass with respect to the phtalocyanine pigment.

4. The electrophotographic photosensitive member according to claim 1, wherein the dipole moment of the dicyanoethylene compound represented by the formula (1) is 6.5 debye or more, the dipole moment being obtained from the results of molecular orbital calculation by density functional calculation at the B3LYP/6-31 G level.

5. The electrophotographic photosensitive member according to claim 1, wherein, in the formula (1), $R^1$ and $R^2$ each represent an amino group substituted with a pyridyl group, a piperidyl group, an alkyl group, or an aryl group, or an aryl group substituted with a secondary amine or a tertiary amine.

6. The electrophotographic photosensitive member according to claim 1, wherein the lowest unoccupied molecular orbital (LUMO) of the dicyanoethylene compound is in the range of −2.4 eV to −2.0 eV, the LUMO being obtained from the results of molecular orbital calculation by density functional calculation at the B3LYP/6-31 G level.

7. The electrophotographic photosensitive member according to claim 1, wherein the dicyanoethylene compound is represented by any one of the following formulae (1-1) to (1-3):

(1-1)

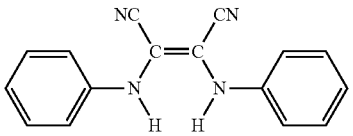

(1-2)

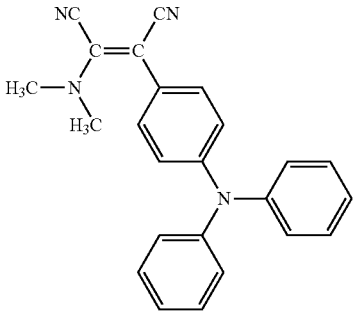

(1-3)

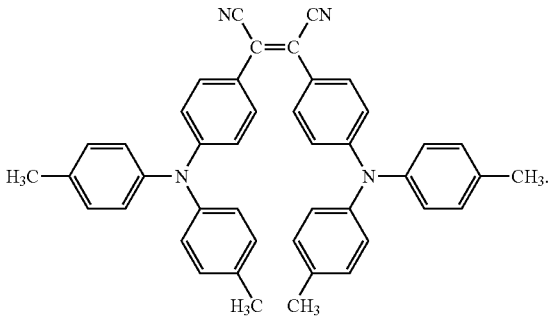

8. The electrophotographic photosensitive member according to claim 1, wherein the phthalocyanine pigment is hydroxygallium phthalocyanine.

9. A process cartridge detachably attachable to a main body of an electrophotographic apparatus, wherein the process cartridge integrally supports:

the electrophotographic photosensitive member according to claim 1, and at least one device selected from the group consisting of a charging device, a developing device, and a cleaning device.

10. An electrophotographic apparatus comprising:

the electrophotographic photosensitive member according to claim 1;

a charging device;

an exposure device;

a developing device; and a transferring device.

11. An electrophotographic photosensitive member comprising:

a support;

an undercoat layer formed on the support; and a photosensitive layer formed on the undercoat layer, wherein the photosensitive layer comprises a phthalocyanine pigment, and the undercoat layer comprises a dicyanoethylene compound represented by the following formula (1):

(1)

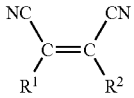

wherein, in the formula (1), $R^1$ and $R^2$ each independently represent an unsubstituted or substituted alkyl group, an unsubstituted or substituted aryl group, an unsubstituted or substituted pyridyl group, an unsubstituted or substituted thienyl group, an unsubstituted or substituted piperidyl group, or a substituted amino group.

12. The electrophotographic photosensitive member according to claim 11, wherein the photosensitive layer comprises:

a charge-generating layer; and a charge-transporting layer formed on the charge-generating layer, wherein the charge-generating layer comprises the phthalocyanine pigment.

13. The electrophotographic photosensitive member according to claim 11, wherein the dipole moment of the dicyanoethylene compound represented by the formula (1) is 6.5 debye or more, the dipole moment being obtained from the results of molecular orbital calculation by density functional calculation at the B3LYP/6-31 G level.

14. The electrophotographic photosensitive member according to claim 11, wherein, in the formula (1), $R^1$ and $R^2$ each represent an amino group substituted with a pyridyl group, a piperidyl group, an alkyl group, or an aryl group, or an aryl group substituted with a secondary amine or a tertiary amine.

15. The electrophotographic photosensitive member according to claim 11, wherein the lowest unoccupied molecular orbital (LUMO) of the dicyanoethylene compound is in the range of −2.4 eV to −2.0 eV, the LUMO being obtained from the results of molecular orbital calculation by density functional calculation at the B3LYP/6-31 G level.

16. The electrophotographic photosensitive member according to claim 11, wherein the dicyanoethylene compound is represented by any one of the following formulae (1-1) to (1-3):
(1-1)
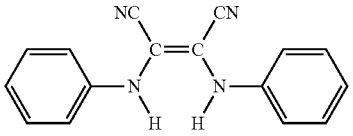
(1-2)
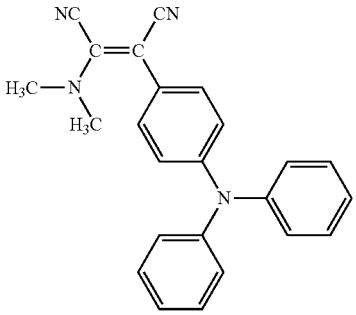
-continued
(1-3)
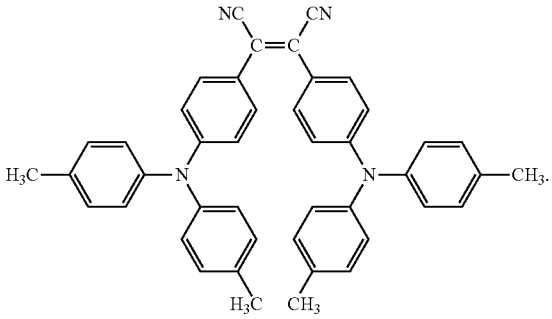
17. The electrophotographic photosensitive member according to claim 11,
wherein the phthalocyanine pigment is hydroxygallium phthalocyanine.
* * * * *